US005503211A

United States Patent [19]

Engi

[11] Patent Number: 5,503,211

[45] Date of Patent: Apr. 2, 1996

[54] FLEXIBLE SAFETY SCREEN

[76] Inventor: Everett C. Engi, 1830 Bonn, Bossier City, La. 71112

[21] Appl. No.: 238,911

[22] Filed: May 6, 1994

[51] Int. Cl.[6] ..... E06B 9/56

[52] U.S. Cl. ..... 160/290.1; 160/300; 160/DIG. 7; 160/DIG. 8; 292/DIG. 15

[58] Field of Search ..... 160/290.1, 310, 160/300, 303, 133, DIG. 7, DIG. 8; 292/101, 203, 202, 304, DIG. 15

[56] References Cited

U.S. PATENT DOCUMENTS

| | | | |
|---|---|---|---|
| 809,994 | 1/1900 | Springer | 160/290.1 X |
| 1,395,475 | 11/1921 | Bried | 160/290.1 X |
| 2,019,084 | 10/1935 | Miller | 160/330 X |
| 2,173,429 | 9/1939 | Sample | 160/290.1 |
| 3,421,568 | 1/1969 | Youngs | 160/310 |

*Primary Examiner*—Blair M. Johnson
*Attorney, Agent, or Firm*—John M. Harrison

[57] ABSTRACT

A flexible safety screen which is designed for storage in an enclosure located above a doorway and deployment downwardly from the enclosure for tensioned attachment to the floor, in order to protect the occupants in a room from intruders. In a first preferred embodiment the screen is rolled on a shaft journalled for rotation in the housing and deployed by means of an electric motor and gear mechanism and according to a second embodiment of the invention, the screen is alternatively manually rolled on the shaft and deployed from the shaft and housing and tightened after being secured to the floor, by means of a crank and ratchet mechanism. In a most preferred embodiment of the invention the screen is characterized by flexible nylon webbing.

13 Claims, 2 Drawing Sheets

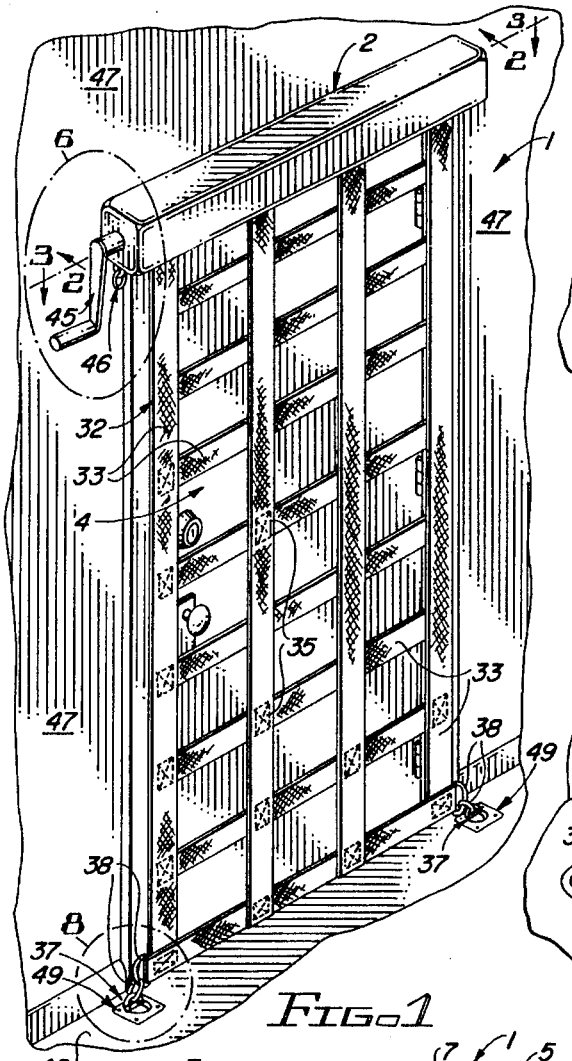
FIG. 1
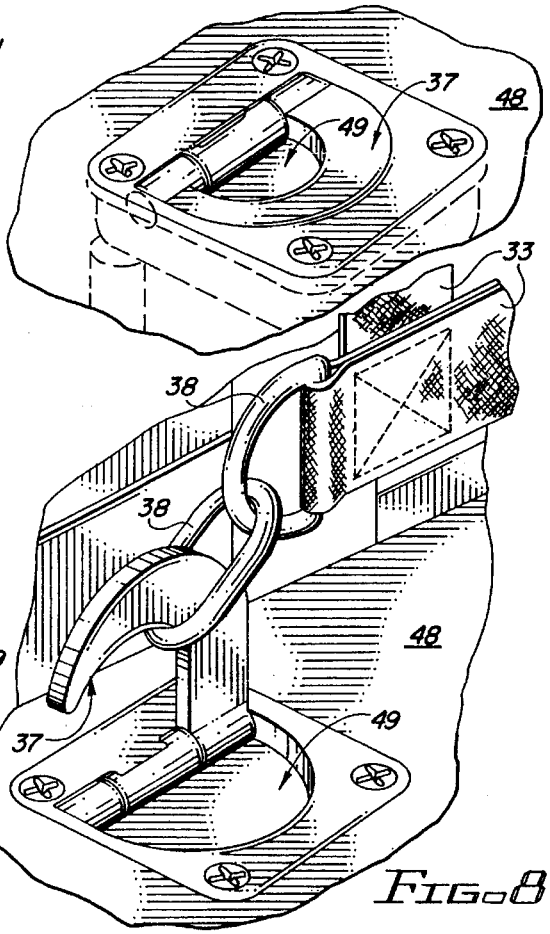
FIG. 7
FIG. 8
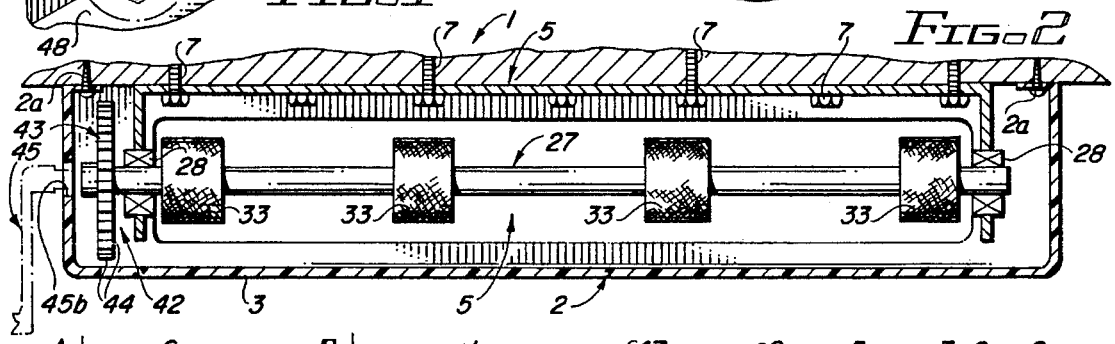
FIG. 2
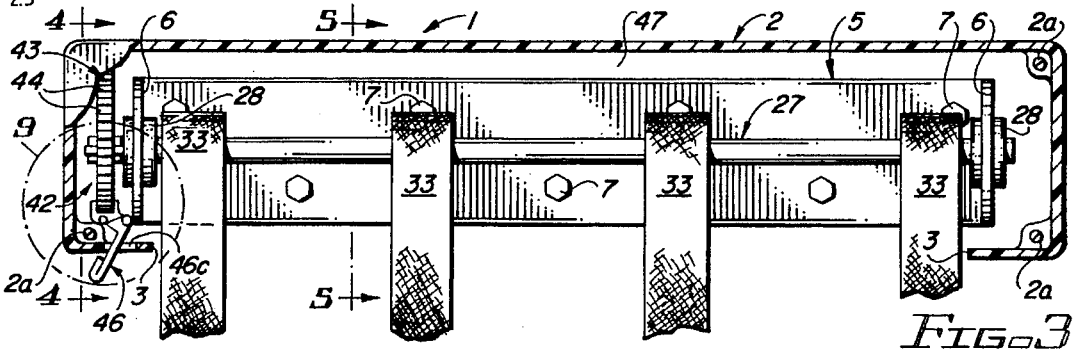
FIG. 3

FLEXIBLE SAFETY SCREEN

BACKGROUND OF THE INVENTION

FIELD OF THE INVENTION

This invention relates to security devices and more particularly, to a home security device which is characterized by a flexible nylon belt screen adapted for storage in a roll on a shaft journalled for rotation in an enclosure positioned above a doorway. The device is optionally deployed downwardly for attachment to the floor and is then tensioned to block the doorway and protect the occupants of a room from an intruder. In a first preferred embodiment the flexible safety screen is wound on and unwound from the shaft by an electric motor and a gear system located in the enclosure. In a second preferred embodiment of the invention the rotatable shaft is attached to a ratchet and pawl system and is fitted with a removable crank or ratchet device to facilitate manual rolling of the flexible screen on the shaft and deployment of the flexible screen from the shaft and housing to block the doorway.

In recent years there has been a rapid development in various types of safety devices, particularly for home use, in light of the increasing crime rate. These devices include yoke-type implements which are designed to prevent a door from being opened by an intruder, some of which implements are equipped with audible alarm systems. Various types of latching devices, including the well known chain latch for securing a door in a partially open position, are also popular. Door blocking devices which may be mounted on the floor inside the door to prevent the door from opening past a predetermined point are also known in the art. These devices are all designed to prevent an intruder from entering a home or business structure when the normal locking mechanism is secured or when a door is forced or voluntarily partially opened. In addition, various types of electronic alarm systems are well known in the art, which devices include perimeter, vibration and motion alarms for guarding the occupants of a dwelling or other structure from intrusion.

It is an object of this invention to provide a flexible safety screen which may be installed above any doorway or access opening to protect a room or area from immediate entry by an intruder.

Another object of the invention is to provide a flexible safety screen which may be stored in a cabinet or enclosure located over a doorway and quickly and easily deployed to block the doorway and prevent, or at least slow, an intruder from entering the room or enclosure.

Still another object of the invention is to provide a new and improved flexible nylon belt safety screen for storage in a cabinet or enclosure located over a doorway to be secured, wherein the safety screen is wound on a rotatable drum or axle powered by an electric motor and gear system for selective deployment of the screen to block the doorway and retraction of the screen into the enclosure.

Yet another object of this invention is to provide a nylon belt flexible safety screen apparatus for securing an enclosure or room at the entrance thereof, which apparatus includes an enclosure or cabinet mounted above the doorway and a bar or axle journalled for rotation in the enclosure and fitted with a ratchet and pawl system and a crank which can be manually operated to selectively roll the screen on the bar in stored configuration in the enclosure and deploy the screen manually from the enclosure to secure the enclosure.

SUMMARY OF THE INVENTION

These and other objects of the invention are provided in a flexible safety screen apparatus characterized by a nylon belt safety screen or webbing which is rolled on a rotatable bar mounted inside an enclosure or cabinet located above a doorway to be secured and may be deployed, either automatically by means of an electric motor, or manually by operation of a ratchet and pawl system and a crank, from the enclosure, attached to floor hooks and subsequentially tensioned, to secure the doorway and prevent intruders from immediately passing through the doorway.

BRIEF DESCRIPTION OF THE DRAWINGS

The invention will be better understood by reference to the accompanying drawings, wherein:

FIG. 1 is a perspective view of a first preferred embodiment of the flexible safety screen of this invention, wherein the safety screen is operated by a crank, as well as a ratchet and pawl assembly;

FIG. 2 is a sectional view taken along line 2—2 of the flexible safety screen illustrated in FIG. 1;

FIG. 3 is a sectional view taken along line 3—3 of the flexible safety screen illustrated in FIG. 1;

FIG. 7 is a perspective view of a preferred recessed hook assembly for securing the flexible safety screen in deployed configuration;

FIG. 8 is a perspective view, partially in section, of the recessed hook securing the flexible screen in deployed configuration;

DESCRIPTION OF THE PREFERRED EMBODIMENTS

Figure 10:
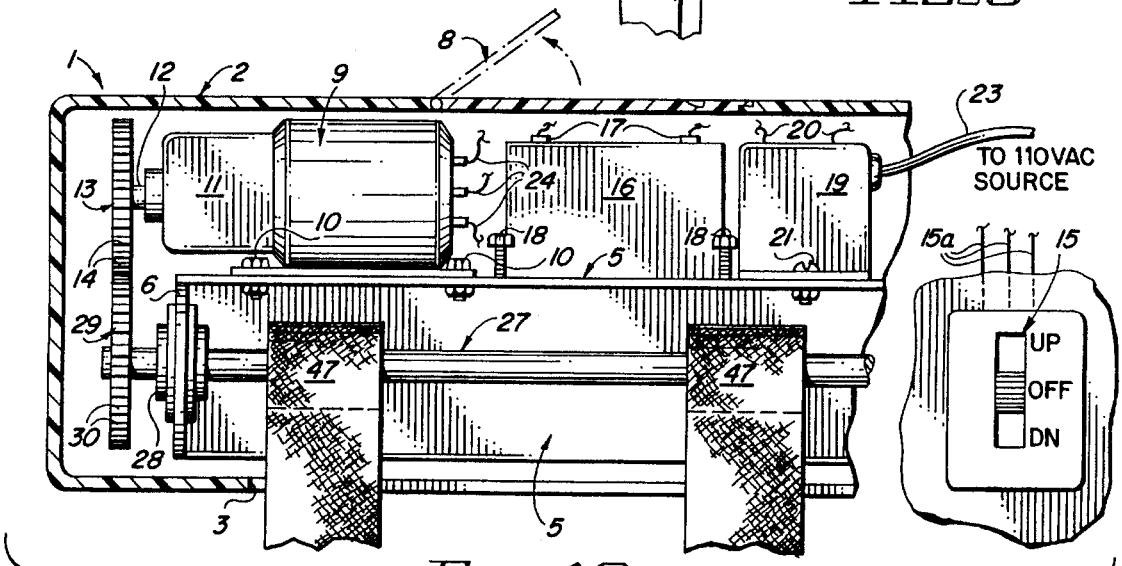
FIG. 10 is a sectional view of an alternative motor-driven embodiment of the flexible safety screen of this invention.

Referring initially to FIGS. 1–3 and 10 of the drawings, in a first preferred embodiment the flexible safety screen of this invention is generally illustrated by reference numeral 1. The flexible safety screen 1 is characterized by a screen housing or enclosure 2, mounted on a wall 47 by means of housing mount screws **2*a* and provided with an elongated bottom screen access opening 3 for deploying a screen 32 from a screen mount bar 27, journalled for rotation in the screen housing 2 over a door 4, as hereinafter further described. The screen mount bar 27 is rotatably deployed in a pair of mount bar bearings 28, mounted in spaced-apart plate brackets 6, extending from a mount plate 5, which is attached to the inside of the screen housing 2 by means of bracket bolts 7, as illustrated in FIG. 2. As illustrated in FIG. 10, in an automatic version of the flexible safety screen 1, a direct current motor 9, fitted with an optional gearbox 11, is mounted on the mount plate 5 by means of motor mount bolts 10 and is electrically connected by means of motor wiring 24 to a battery 16, also mounted on the mount plate 5 by means of battery mount bolts 18. The battery 16 is accessed in the screen housing 2 by means of a battery access panel 8, as illustrated in FIG. 10. The motor wiring 24 is attached to the battery terminals 17 and to the switch wiring 15***a* of a conventional motor switch 15, in conventional manner and battery charging wiring 20 connects the respective battery terminals 17 to a battery charger 19, which is likewise attached to the mount plate 5 by means of charger mount bolts 21. A plug (not illustrated) is connected to the battery charger 19 by means of a plug cord 23 and may be plugged into a conventional plug receptacle (not illustrated) in conventional fashion to power the battery charger 19 and facilitate maintaining the battery 16 at a fully charged level to power the motor 9 on demand. As described above, the three-position motor switch 15 may be wired to the motor 9 in conventional fashion by means of switch wiring 15*a* to facilitate operation of the reversible motor 9 in either direction, as hereinafter further described. The motor 9 is further provided with a motor or gearbox shaft 12, having a motor shaft gear 13 keyed on the end thereof in conventional manner, the motor shaft gear 13 having motor shaft gear teeth 14. A mount bar gear 29 is secured to one end of the screen mount bar 27, wherein the mount bar gear teeth 30 engage the motor shaft gear teeth 14 of the motor shaft gear 13. This mechanical arrangement facilitates rotation of the screen mount bar 27 in either direction, depending upon the direction of rotation of the motor 9, responsive to manipulation of the motor switch 15, as the motor shaft gear teeth 14 of the motor shaft gear 13 engage the mount bar gear teeth 30 of the mount bar gear 29, as illustrated in FIG. 10.

Figure 4:
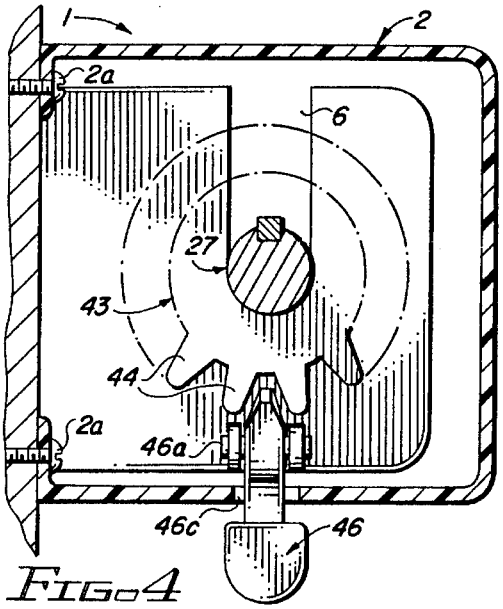
FIG. 4 is a sectional view taken along line 4–4 of the flexible safety screen illustrated in FIG. 3.
Figure 5:
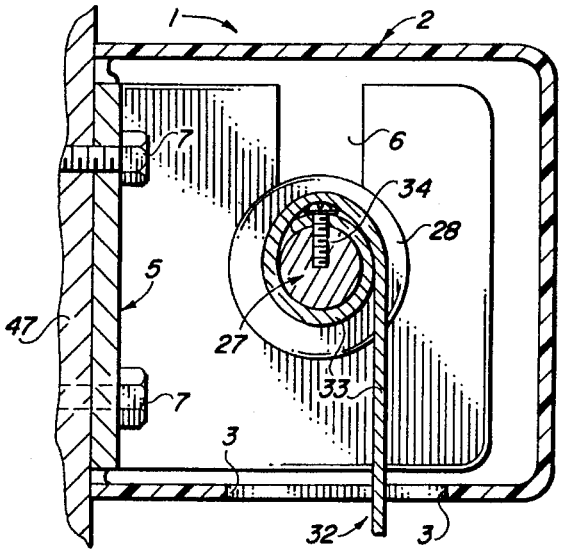
FIG. 5 is a sectional view taken along line 5—5 of the flexible safety screen illustrated in FIG. 3.
Figure 9:
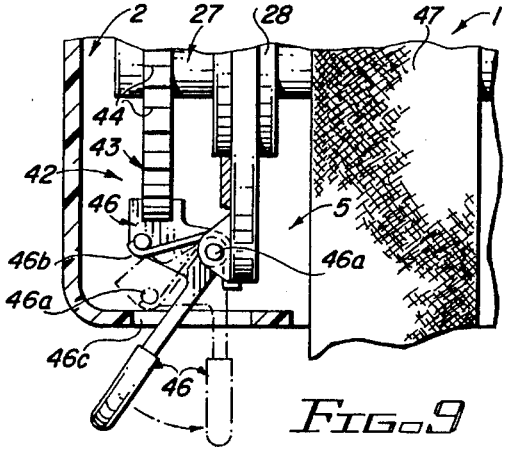
FIG. 9 is a sectional view of the flexible screen and a ratchet assembly for deploying the flexible screen into and from the housing.

Referring again to FIGS. 1 and 5 of the drawings, in a most preferred embodiment of the invention the screen 32 is characterized by nylon screen webbing 33, the vertical members or bands of which are attached to the screen mount bar 27 in spaced relationship with respect to each other by means of webbing mount bolts 34, as illustrated in FIG. 5. The horizontal and vertical strands or belts of screen webbing 33 are attached at spaced intervals by webbing stitching 35 to provide a network of open spaces that are sufficiently small to prevent traversal by an individual. Accordingly, as further illustrated in FIG. 1 and referring also to FIGS. 7 and 8, the webbing screen 32 can be deployed downwardly to the floor level and a pair of chain links 38, attached to the ends of the bottom horizontally-oriented element of the belted screen webbing 33, can be quickly and easily attached to a corresponding pair of normally recessed locking hooks 37, each pivotally mounted in a locking hook recess 49 in the floor 48 of a dwelling or other structure. This action secures the screen 32 in position over the doorway closed by the door 4 and prevents traversal of the doorway by an intruder, either when the door 4 is left open or if it is forced open, as further hereinafter described.

Figure 6:
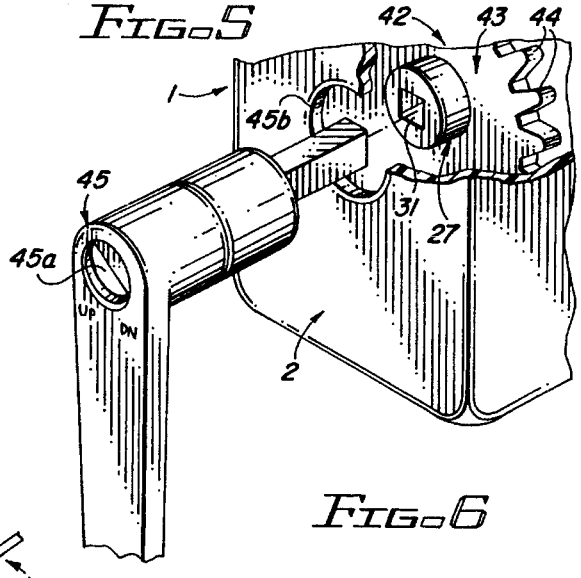
FIG. 6 is a perspective view, partially in section, of a preferred ratchet crank for manually operating the flexible safety screen.

Referring again to FIG. 1 and to FIGS. 4–9 of the drawings, in another preferred embodiment of the invention the flexible safety screen 1 is configured for manual operation without a motor, wherein a crank 45, which may include a crank ratchet 45*a*, is inserted through a crank opening 45*b* in the screen housing 2 and into a mount bar socket 31, provided in the end of the screen mount bar 27, as illustrated in FIG. 6, for rotating the screen mount bar 27 in either direction within the screen housing 2, as hereinafter further described. Accordingly, the crank 45 may be used to crank the screen 32 onto and from the screen housing 2. The socket end of the screen mount bar 27 is also fitted with a ratchet mechanism 42, which includes a ratchet gear 43, fixed to the screen mount bar 27 and a pawl 46, pivotally attached to the mount plate 5 by means of a pawl pivot pin 46*a* and a pawl spring 46*b*. The pawl 46 projects through a pawl opening 46*c* in the screen housing 2, for selective engagement with the ratchet gear teeth 44 provided on the ratchet gear 43, to facilitate tensioning of the screen 32 using the crank 45, as hereinafter further described.

Referring again to FIGS. 1, 8 and 10 of the drawings, under circumstances where it is desired to deploy or extend the screen 32 from the screen housing 2 using the electric motor 9, the motor switch 15 is manipulated to the "down" position, which energizes the motor 9 and unwinds the screen 32 from the screen mount bar 27 as the screen mount bar 27 rotates in the appropriate direction by operation of the meshing motor shaft gear 13 and mount bar gear 29. When the screen 32 is fully deployed such that the extending end thereof reaches the floor 48 adjacent to the doorway and the closed door 4, the chain links 38, attached to each end of the bottom horizontal strand or belt of the screen webbing 33, are engaged with corresponding pivoting locking hooks 37, which are normally recessed in the locking hook recesses 49, mounted in the floor 48, as illustrated to FIG. 8. The screen webbing 33 of the screen 32 is then tensioned by manipulating the motor switch 15 into the opposite, or "up" direction, to begin winding the screen 32 back on the screen mount bar 27, a procedure which tightly tensions the screen webbing 33 and the chain links 38 and thus prevents manipulation of the chain links 38 from the respective locking hooks 37 by an intruder. This action secures the room served by the door 4 from entry by an intruder and allows sufficient time for the occupant to contact the police or take other appropriate action before the intruder can cut the screen webbing 33 and enter the room or enclosure.

Referring now to FIGS. 1–9 of the drawings, in the second preferred embodiment of the invention, under circumstances where the screen 32 is deployed by operation of the crank 45 and the ratchet mechanism 42, the screen mount 27 is rotated to unroll the screen webbing 33 by initially pivoting the pawl 46 on the pawl pivot pin 46*a* from the ratchet gear teeth 44 of the ratchet gear 43 against the bias of the pawl spring 46*b* and manually deploying the screen 32 downwardly through the screen access opening 3 and the screen housing 2 by gravity, or by insertion of the crank 45 in the mount bar socket 31, as illustrated in FIG. 6. The chain links 38 are then engaged with the respective locking hooks 37, mounted on the floor 48, as described above and the screen webbing 33 is tensioned by again inserting the crank 45 into the mount bar socket 31 to rotate the screen mount bar 27 in the opposite, or "up" direction. When the desired degree of tension is applied in the screen webbing 33, the pawl 46 is released and pivoted into engagement with the ratchet gear teeth 44 of the ratchet gear 43 by application of the pawl spring 46*b* to maintain the screen 32 in a tensioned configuration and effectively block the doorway closed by the door 4.

Referring again to FIGS. 1–10 of the drawings, under circumstances where it is desired to rewind the flexible screen 32 on the screen mount bar 27, tension is first released in the screen webbing 33. This is accomplished by initially rotating the screen mount bar 27 to lower the screen 32 using the crank 45, as described with respect to FIGS. 1–9, or by manipulating the motor switch 15 to the "down" position to energize the motor 9, as illustrated with respect to FIG. 10. When slack is provided in the screen webbing 33, the chain links 38 are easily removed from the respective locking hooks 37 and the locking hooks 37 are again pivoted into the floor recesses 49 in the floor 48, as the screen 32 is redeployed or wound on the screen mount bar 27 within the screen housing 2 by winding the crank in the opposite direction or manipulating the motor switch 15 to the "up" position, as required.

It will be appreciated by those skilled in the art that the screen 32 may be constructed of screen webbing 33 of any desired character. However, in a most preferred embodiment of the invention, the screen webbing 33 is characterized by heavy-duty nylon belts which are difficult to cut and virtually impossible to tear. Furthermore, the flexible safety screen 1 can be installed over any opening, to screen that opening from intruders, whether or not a door 4 is hung in the opening.

While the preferred embodiments of the invention have been described above, it will recognized and understood that various modifications may be made in the invention and the appended claims are intended to cover all such modifications which may fall within the scope and spirit of the invention.

Having described my invention with the particularity set forth above, what is claimed is:

1. A flexible safety screen for blocking an access in a structure having a floor, comprising screen mount means rotatably mounted on the structure in close proximity to the access; a flexible webbing screen having a first set of nylon bands with one end attached to said screen mount means and disposed in spaced, vertical, substantially parallel orientation with respect to each other when said flexible webbing screen is deployed from said screen mount means; a second set of nylon bands disposed in spaced, horizontal, substantially parallel orientation with respect to each other and intersecting said first set of nylon bands; and stitching joining said first set of nylon bands to said second set of nylon bands, said flexible webbing screen carried by said screen mount means for deployment from said screen mount means responsive to rotation of said screen mount means in a first direction to block the access, and said flexible webbing screen deployed in rolled configuration on said screen mount means responsive to rotation of said screen mount means in the reverse direction to remove said flexible webbing screen from blocking the access; first securing means mounted in the floor of the structure adjacent to the access; second securing means carried by said flexible webbing screen for removably engaging said first securing means and removably securing said flexible webbing screen to the floor when said flexible webbing screen is fully deployed from said screen mount means; and tensioning means engaging said screen mount means for rotating said screen mount means and selectively tensioning said flexible webbing screen, said first securing means and said second securing means and removably securing said flexible webbing screen across the access to block passage through the access.

2. The flexible safety screen of claim 1 comprising a reversible electric motor mounted on the structure above the access; a motor shaft rotatably provided in said electric motor and a motor shaft gear fixed to said motor shaft; and wherein said screen mount means comprises a screen mount bar rotatably mounted on the structure in spaced, substantially parallel relationship with respect to said motor shaft for receiving said flexible webbing screen and comprising a mount bar gear fixed to said screen mount bar and engaging said motor shaft gear, whereby energizing of said electric motor for rotation of said motor shaft in said first direction extends said flexible webbing screen from said screen mount bar to cover the access and energizing of said electric motor for rotation of said motor shaft in said reverse direction rolls said flexible webbing screen on said screen mount bar and removes said flexible webbing screen from blocking the access.

3. The flexible safety screen of claim 1 wherein said first securing means comprises at least two hooks pivotally recessed in the floor of the structure and said second securing means comprises at least two chain links for removably engaging said hooks, respectively.

4. The flexible safety screen of claim 5 comprising an electric motor mounted on the structure above the access; a motor shaft rotatably provided in said electric motor and a motor shaft gear fixed to said motor shaft; and wherein said screen mount means comprises a screen mount bar rotatably mounted on the structure in spaced, substantially parallel relationship with respect to said motor shaft for receiving said flexible webbing screen and comprising a mount bar gear fixed to said screen mount bar and engaging said motor shaft gear, whereby energizing of said electric motor for rotation of said motor shaft in said first direction extends said flexible webbing screen from said screen mount bar to cover the access and energizing of said electric motor for rotation of said motor shaft in said reverse direction rolls said flexible webbing screen on said screen mount bar and removes said flexible webbing screen from blocking the access.

5. The flexible safety screen of claim 1 comprising an enclosure mounted on the structure above the access and wherein said screen mount means is disposed in said enclosure and said flexible webbing screen is disposed on said screen mount means when said screen mount means is fully rotated in said reverse direction.

6. The flexible safety screen of claim 5 comprising an electric motor mounted on the structure above the access; a motor shaft rotatably provided in said electric motor and a motor shaft gear fixed to said motor shaft; and wherein said screen mount means comprises a screen mount bar rotatably mounted on the structure in spaced, substantially parallel relationship with respect to said motor shaft for receiving said flexible webbing screen and comprising a mount bar gear fixed to said screen mount bar and engaging said motor shaft gear, whereby energizing of said electric motor for rotation of said motor shaft in said first direction extends said screen means from said screen mount bar to cover the access, and energizing of said electric motor for rotation of said motor shaft in said reverse direction rolls said screen on said screen mount bar and removes said flexible webbing screen from blocking the access.

7. The flexible safety screen of claim 6 wherein said first securing means comprises at least two hooks pivotally recessed in the floor of the structure and said second securing means comprises at least two chain links for removably engaging said hooks, respectively.

8. The flexible safety screen of claim 1 comprising a ratchet gear fixed to said screen mount means; a pawl pivotally mounted on said structure for selective engagement with said ratchet gear and preventing said screen mount means from rotating in said first direction after said flexible webbing screen is deployed over the access and said first securing means is engaged with said second securing means; crank receiving means provided in said screen mount means and crank means for selective insertion in said crank receiving means and selectively rotating said screen mount means in said first direction and said reverse direction and deploying said flexible webbing screen to and from blocking of the access.

9. The safety screen of claim 8 wherein said first securing means comprises at least two hooks pivotally recessed in the floor of the structure and said second securing means comprises at least two chain links for removably engaging said hooks, respectively.

10. The flexible safety screen of claim 8 comprising an enclosure mounted on the structure above the access and wherein said screen mount means is disposed in said enclosure and said flexible webbing screen is disposed on said screen mount means when said screen mount means is fully rotated in said reverse direction.

11. The safety screen of claim 10 wherein said first securing means comprises at least two hooks pivotally recessed in the floor of the structure and said second securing means comprises at least two chain links for removably engaging said hooks, respectively.

12. A flexible safety screen for blocking a doorway in a structure having a floor, comprising an enclosure mounted in the structure above the doorway and an opening provided in the bottom of said enclosure; a screen mount bar journalled for rotation in said enclosure above said opening and a mount bar gear fixed to said screen mount bar; a reversible electric motor provided in said enclosure, a motor switch electrically connected to said electric motor, a motor shaft extending from said electric motor in rotatable relationship and a motor shaft gear fixed to said motor shaft, said motor shaft gear engaging said mount bar gear; a flexible webbing screen having a top end and a bottom end, with said top end attached to said screen mount bar, said flexible webbing screen having a first set of nylon bands disposed in spaced, vertical, substantially parallel orientation with respect to each other when said screen is deployed from said screen mount bar, a second set of nylon bands disposed in spaced horizontal, substantially parallel orientation with respect to each other and intersecting said first set of nylon bands and stitching joining said first set of nylon bands to said second set of nylon bands; at least two hooks pivotally recessed in the floor of the structure in close proximity to the doorway and in spaced relationship with respect to each other; and at least two chain links carried by said bottom end of said flexible webbing screen in spaced relationship with respect to each other, whereby said flexible webbing screen is rolled on said screen mount bar and deployed in said enclosure responsive to manipulation of said motor switch and operation of said electric motor in a first selected direction, and said webbing screen is unrolled from said screen mount bar and deployed through said opening in said enclosure responsive to manipulation of said motor switch and operation of said electric motor in the reverse direction, to block the doorway when said chain links are engaged with said hooks, respectively.

13. A flexible safety screen for blocking a doorway in a structure having a floor, comprising an enclosure mounted in the structure above the doorway and an opening provided in the bottom of said enclosure; a screen mount bar journalled for rotation in said enclosure above said opening; a ratchet gear fixed to said screen mount bar; a pawl pivotally mounted in said housing for selective engagement with said ratchet gear and preventing said screen mount bar from rotating; crank receiving means provided in said screen mount bar and crank means for insertion in said crank receiving means, for rotating said screen mount bar in a selected direction; a flexible webbing screen having a top end and a bottom end, with said top end attached to said screen mount bar, said flexible webbing screen having a first set of nylon bands disposed in spaced, vertical substantially parallel orientation with respect to each other when said screen is deployed from said screen mount bar, a second set of nylon bands disposed in spaced, horizontal, substantially parallel orientation with respect to each other and intersecting said first set of nylon bands and stitching joining said first set of nylon bands to said second set of nylon bands; at least two hooks pivotally recessed in the floor of the structure in close proximity to the doorway and in spaced relationship with respect to each other; and at least two chain links carried by said bottom end of said flexible webbing in spaced relationship with respect to each other, whereby said flexible webbing screen is rolled on said screen mount bar and deployed in said enclosure responsive to manipulation of said crank means by said tensioning bar in a first selected direction and said flexible webbing screen is unrolled from said screen mount bar and deployed through said opening in said enclosure responsive to manipulation of said crank means in a reverse direction, to block the doorway when said chain links are engaged with said hooks, respectively.

* * * * *